US008240879B2

(12) United States Patent
Hsu et al.

(10) Patent No.: US 8,240,879 B2
(45) Date of Patent: Aug. 14, 2012

(54) ILLUMINATION MODULE

(75) Inventors: Chia-Yun Hsu, Taipei Hsien (TW); Ying-Jhong Chen, Taipei Hsien (TW)

(73) Assignee: Everlight Electronics Co., Ltd., Shulin Dist., New Taipei (TW)

( * ) Notice: Subject to any disclaimer, the term of this patent is extended or adjusted under 35 U.S.C. 154(b) by 237 days.

(21) Appl. No.: 12/624,416

(22) Filed: Nov. 24, 2009

(65) Prior Publication Data

US 2010/0128476 A1 May 27, 2010

(30) Foreign Application Priority Data

Nov. 24, 2008 (TW) ..... 97145309 A

(51) Int. Cl.
*F21V 7/00* (2006.01)
*F21S 4/00* (2006.01)

(52) U.S. Cl. ... 362/241; 362/240; 362/247; 362/249.02; 362/249.06

(58) Field of Classification Search ..... 362/240, 362/241, 247, 249.02, 249.04, 249.06
See application file for complete search history.

(56) References Cited

U.S. PATENT DOCUMENTS

| | | | | |
|---|---|---|---|---|
| 6,244,728 | B1 * | 6/2001 | Cote et al. | 362/249.06 |
| 6,250,774 | B1 * | 6/2001 | Begemann et al. | 362/231 |
| 7,631,985 | B1 * | 12/2009 | Knoble et al. | 362/225 |
| 2009/0034257 | A1 * | 2/2009 | Liu et al. | 362/252 |

FOREIGN PATENT DOCUMENTS

| | | |
|---|---|---|
| CN | 201041311 Y | 3/2008 |
| TW | 200732592 | 9/2007 |
| TW | M335632 | 7/2008 |
| TW | M341153 | 9/2008 |

* cited by examiner

*Primary Examiner* — Thomas Sember
(74) *Attorney, Agent, or Firm* — Winston Hsu; Scott Margo

(57) ABSTRACT

An illumination module includes a substrate and a plurality of LED devices. The substrate has a main plane, and the main plane includes a central region and a peripheral region. The LED devices are disposed on the main plane of the substrate in the central region and peripheral region. Each of the LED devices has a light-exiting direction, where the light-exiting direction of the LED device disposed in the central region is substantially perpendicular to the main plane, and the light-exiting direction of each of the LED devices in the peripheral region goes outwards with respect to the central region.

12 Claims, 6 Drawing Sheets

ILLUMINATION MODULE

BACKGROUND OF THE INVENTION

1. Field of the Invention

The present invention relates to an illumination module, and more particularly, to a light emitting diode (LED) illumination module having a wide illumination range and a uniform illumination.

2. Description of the Prior Art

Currently, most streetlamps are mercury vapor lamps that are disposed at the roadsides to provide illumination at night. The mercury vapor lamps have high power consumption, and thus the bulbs or tubes of the mercury vapor lamps will generate massive heat when used for a long time. In addition to the high power consumption problem, the lamps or tubes will burn or turn black, and this may cause damage to the whole lamp module. In addition, mercury itself is a pernicious material, and will hurt the human brain and nervous system, and therefore mercury should be handled carefully during recycling. Therefore, LEDs having the advantages of light weight, environmental soundness, single color light, low power consumption, and long life time can solve the associated problems of mercury vapor lamps such as power consumption, short life time, massive heat and high pollution.

Please refer to FIG. 1. FIG. 1 is a schematic diagram illustrating a cross-sectional structure of an LED illumination module according to the prior art. As shown in FIG. 1, the LED illumination module 10 of the prior art includes a substrate 12, an LED 14 and a reflective lampshade 16. The LED 14 is disposed on the substrate 12. A sidewall of the reflective lampshade 16 is symmetric about a central line of the reflective lampshade 16, and surrounds the LED 14. Please refer to FIG. 2, which is a radiation diagram illustrating the angular distribution of light from the LED illumination module according to the prior art. As shown in FIG. 2, the angular distribution of light from the LED illumination module according to the prior art is between 30 degrees on the left-hand side and 30 degrees on the right-hand side through measuring the relation of the intensity and the angle of light from the LED illumination module. Therefore, the emitting angle range of the LED illumination module can be defined as substantially 60 degrees.

Please refer to FIG. 3, which is a schematic diagram illustrating the intensity distribution of light from the LED illumination module according to the prior art. As shown in FIG. 3, a simulated road has an x-axis and a y-axis. The LED illumination module 10 is disposed over −50 millimeters of x-axis and at the origin of y-axis of the simulated road. When the measured intensity of light of the distribution curve is 25 watts per square meter, the distribution curve of the light is between 150 millimeters and −50 millimeters of the x-axis and between 110 millimeters and −110 millimeters of the y-axis.

However, the LED illumination module has an insufficient illumination range at the y-axis of the road. A streetlamp and an adjacent streetlamp have a distance between them. When a part of the y-axis of the road illuminated by the light is short, the distance between the streetlamp and the adjacent streetlamp should be shortened. Therefore, more streetlamps should be used to illuminate the whole road, which will cause greater energy consumption. If the number of streetlamps is decreased, a distance of the road with no illumination between the streetlamp and the adjacent streetlamp will be generated because of the limit of the illumination range of the LED illumination module, which will result in more accidents.

SUMMARY OF THE INVENTION

It is therefore a primary objective to provide an illumination module that raises a prior art illumination range.

According to the claimed invention, an illumination module is disclosed. The illumination module comprises a substrate and a plurality of LED devices. The substrate has a main plane, and the main plane comprises a central region and a peripheral region. The LED devices are disposed on the main plane of the substrate in the central region and the peripheral region. Each of the LED devices has a light-exiting direction. The light-exiting direction of each of the LED devices disposed in the central region is substantially perpendicular to the main plane, and the light-exiting direction of each of the LED devices disposed in the peripheral region goes outwards with respect to the central region.

According to the claimed invention, another illumination module is disclosed. The illumination module comprises a substrate, a plurality of LEDs, a plurality of first reflective lampshades and a plurality of second reflective lampshades. The substrate has a main plane, and the main plane comprises a central region and a peripheral region. The LEDs are disposed on the main plane of the substrate in the central region and the peripheral region. Each of the first reflective lampshades respectively has a first central line, and each of the first reflective lampshades is attached to the substrate in the central region and surrounds each of the LEDs in the central region. The first central line of each of the first reflective lampshades is perpendicular to the main plane. Each of the second reflective lampshades respectively has a second central line, and each of the second reflective lampshades is attached to the substrate in the peripheral region and surrounds each of the LEDs in the peripheral region. The second central line of each of the second reflective lampshades inclines outwards with respect to the central region, so that a light-exiting direction of each of the LEDs in the peripheral region goes outwards with respect to the central region through the second reflective lampshade.

The present invention disposes the reflective lampshade surrounding each of the LEDs and changes the inclined direction and angle of the reflective lampshade in the peripheral region to enlarge the illumination range of the LED and make the illumination uniform.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
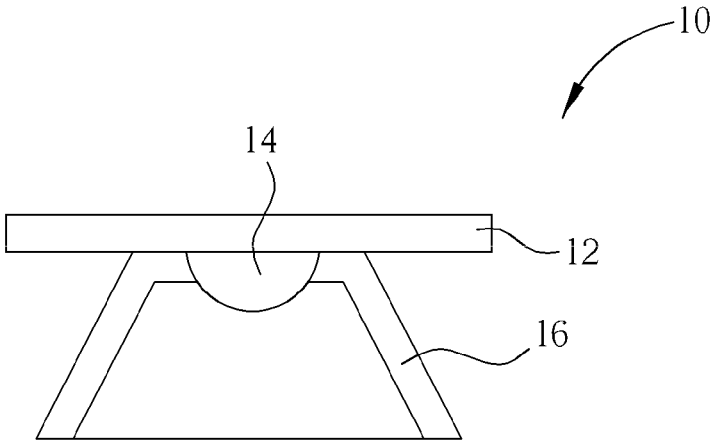
FIG. 1 PRIOR ART
FIG. 1 is a schematic diagram illustrating a cross-sectional structure of an LED illumination module according to the prior art.
Figure 2:
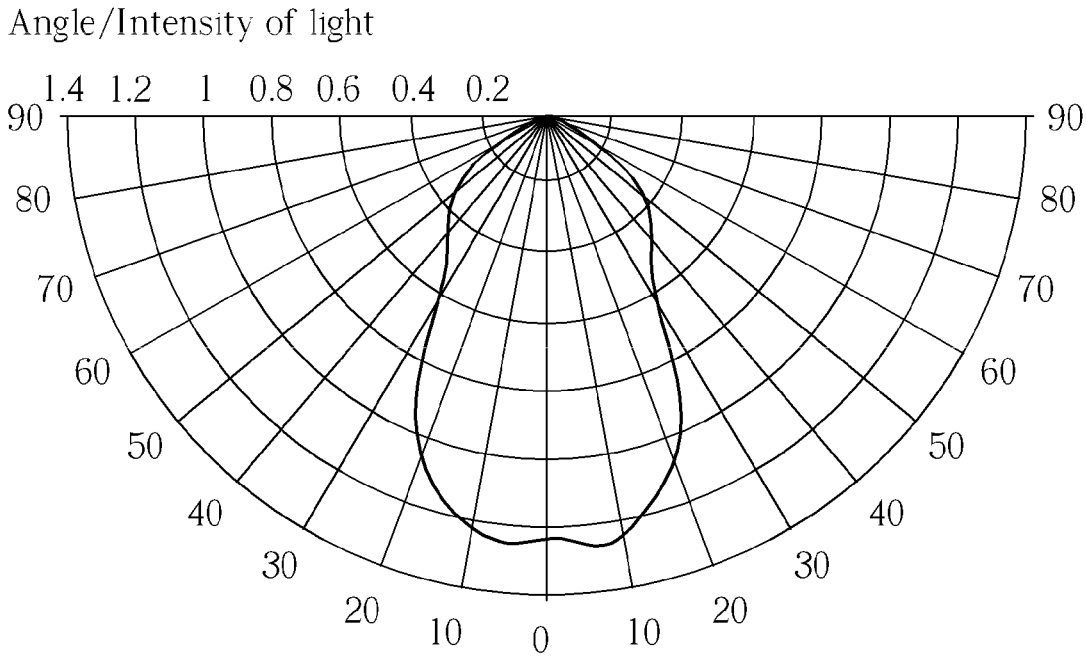
FIG. 2 PRIOR ART
FIG. 2 is a radiation diagram illustrating the angular distribution of light from the LED illumination module according to the prior art.
Figure 3:
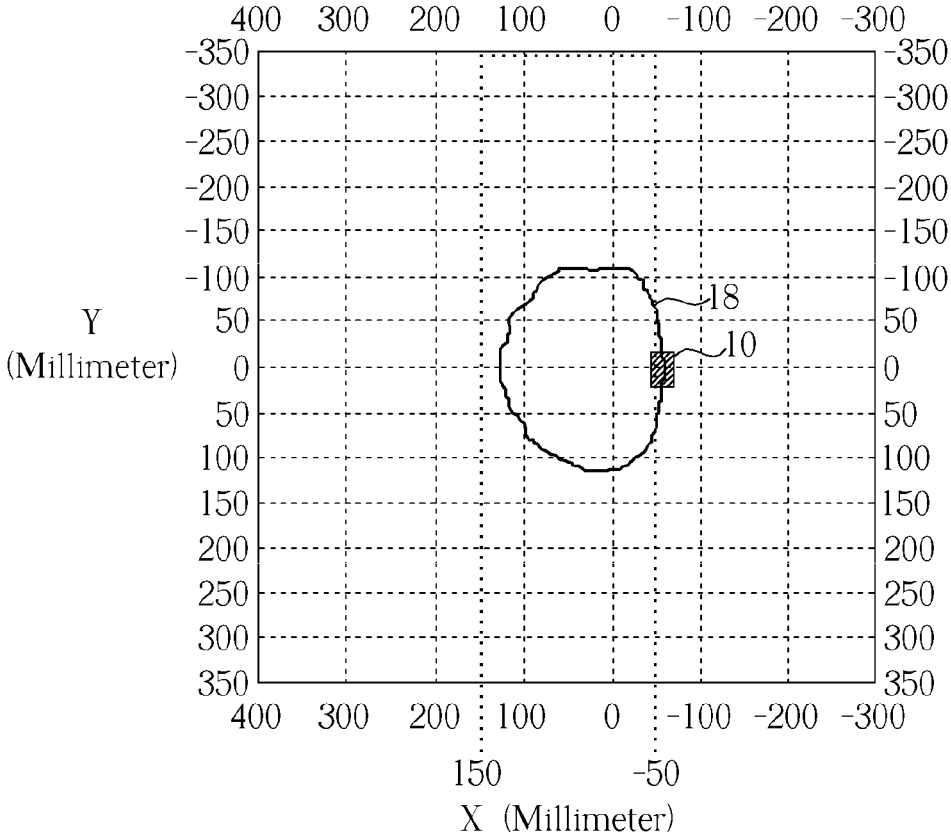
FIG. 3 PRIOR ART
FIG. 3 is a schematic diagram illustrating the intensity distribution of light from the LED illumination module according to the prior art.
Figure 4:
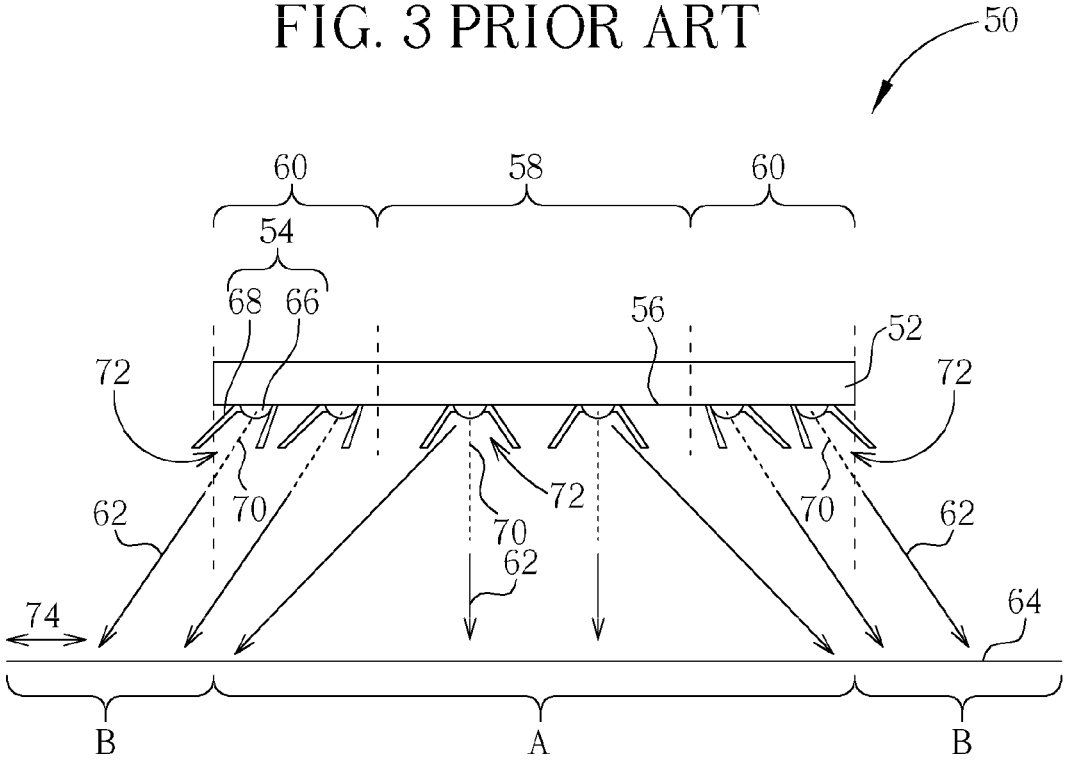
FIG. 4 is a schematic diagram illustrating a cross-sectional structure of an illumination module according to a preferred embodiment of the present invention.
Figure 5:
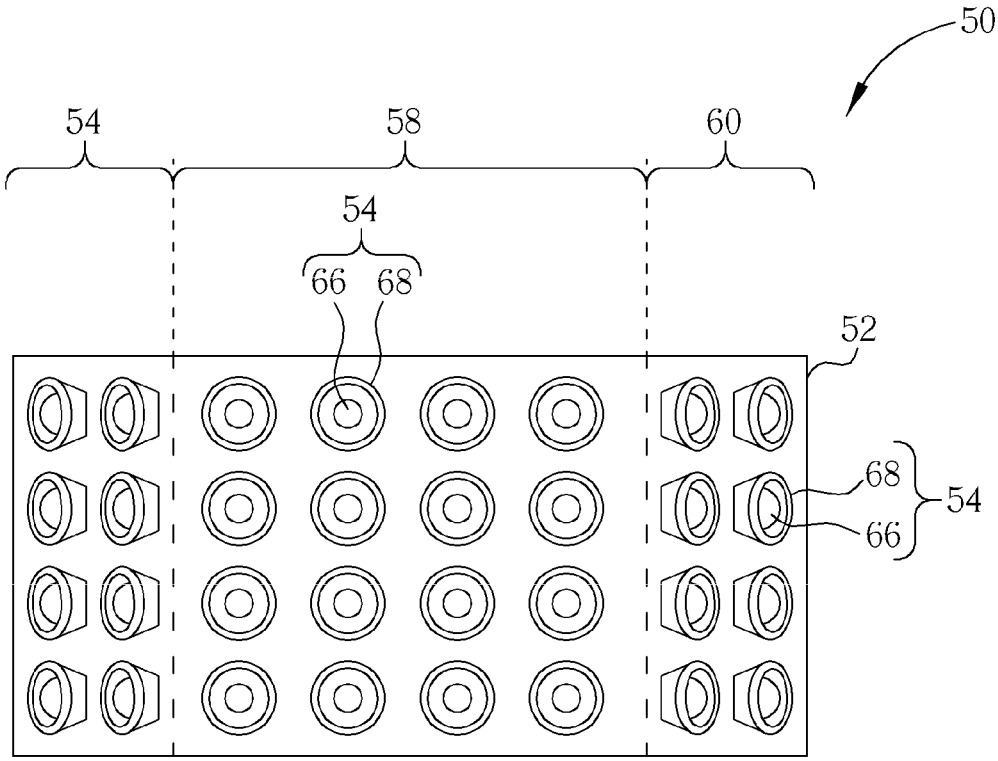
FIG. 5 is a schematic diagram illustrating a top-view structure of an illumination module according to the preferred embodiment of the present invention.

Please refer to FIG. 4 and FIG. 5. FIG. 4 is a schematic diagram illustrating a cross-sectional structure of an illumination module according to a preferred embodiment of the present invention, and FIG. 5 is a schematic diagram illustrating a top-view structure of an illumination module according to the preferred embodiment of the present invention. As shown in FIG. 4 and FIG. 5, the illumination module 50 includes a substrate 52 and a plurality of LED devices 54. The substrate 52 has a main plane 56, and the main plane 56 includes a central region 58 and a peripheral region 60. The LED devices 54 are disposed on the main plane 56 of the substrate 52 in the central region 58 and the peripheral region 60. It should be noted that each of the LED devices has a light-exiting direction 62. The light-exiting directions 62 of the LED devices 54 in the central region 58 are substantially perpendicular to the main plane 56, and the light-exiting directions 62 of the LED devices 54 in the peripheral region 60 go substantially outwards with respect to the central region 58. The light-exiting directions 62 of the LED devices 54 are not limited to this condition, and the light-exiting directions 62 can be adjusted according to designs or requirements. In addition, the light-exiting directions 62 of the LED devices 54 in the peripheral region 60 can also go outwards in a specific angle with respect to the central regions 58 according to designs or requirements. According to the above design, the illumination module of the present invention not only can use the LED devices 54 in the central region 58 to illuminate a middle region A of an illumination area 64, but also can use the LED devices 54 in the peripheral region 60 to illuminate surroundings or two opposite sides of the surrounding region B of the illumination area 64 so as to extend the illumination range of the LED devices 54 in the central region 58.

In addition, each of the LED devices 54 includes an LED 66 and a reflective lampshade 68. Each of the reflective lampshades 68 disposed on the substrate 52 in the central region 58 is defined as a first reflective lampshade 68, and each of the reflective lampshades disposed on the substrate 52 in the peripheral region 60 is defined as a second reflective lampshade 68. The LEDs 66 are disposed on a side of the substrate 52 facing the illumination area 64, and the LEDs 66 are disposed on the main plane 56 of the substrate 52 in the central region 58 and the peripheral region 60. In this embodiment, the LED devices 54 are preferably arranged as a dot matrix. In other words, the LEDs 66 are also arranged as a dot matrix, but the present invention is not limited to this arrangement. The arrangement of the LED devices 54 can be adjusted according to the required illumination form. In addition, each of the reflective lampshades 68 surrounds each of the LEDs 66, and each of the reflective lampshades 68 is attached to the side of the substrate 52 the same as the LEDs 66, so that each of the reflective lampshades 68 has a light-exiting opening 72. Each of the reflective lampshades 68 can direct the light from the corresponding LED 66 to the light-exiting opening 72, and the light can exit by the light-exiting opening 72. Furthermore, each of the reflective lampshades has a central line 70, and the whole structure of each of the reflective lampshades 68 is substantially symmetric about the corresponding central line 70. The central lines 70 of the first reflective lampshades 68 in the central region 58 are defined as first central lines 70, and the central lines 70 of the second reflective lampshades 68 in the peripheral region 60 are defined as second central lines 70. Because each of the reflective lampshades 68 surrounds the corresponding LED 66, the light from the corresponding LED 66 can be directed to the light-exiting opening 72, so that an optical axis of the corresponding LED 66 in the peripheral region 60 can be disposed in a random direction different from the second central line 70. In this embodiment, each of the reflective lampshades 68 is preferably conical shell-shaped, but the present invention is not limited to this shape. The shape of each of the reflective lampshades 68 can be changed according to the design requirements.

In addition, the sidewall and the first central line 70 of each of the first reflective lampshades 68 in the central region 58 has a first included angle, and the sidewall and the second central line 70 of the second reflective lampshades 68 in the peripheral region 60 has a second included angle. The first included angle is larger than the second included angle, so that the emitting angle range of each of the LEDs 66 in the central region 58 through each of the first reflective lampshades 68 is larger than the emitting angle range of each of the LEDs 66 in the peripheral region 60 through each of the second reflective lampshades 68. This means that the emitting angle range of each of the LED devices 54 in the central region 58 is larger than the emitting angle range of each of the LED devices 54 in the peripheral region 60. The present invention is not limited to this, and the emitting angle range of each of the LED devices 54 in the central region 58 can also be smaller than the emitting angle range of each of the LED devices 54 in the peripheral region 60.

Figure 6:
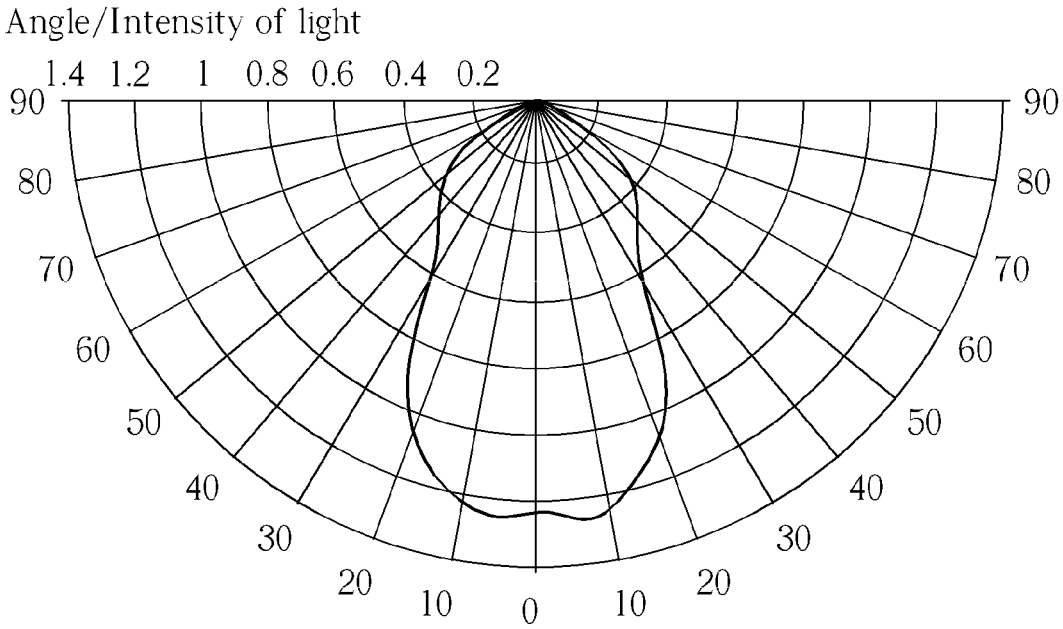
FIG. 6 is a radiation diagram illustrating the distribution of light from the LED devices in the central region according to the present invention.

It should be noted that a sidewall of each of the first reflective lampshades 68 in the central region 58 is symmetric about the central line of the corresponding first reflective lampshade 62. In each of the LED devices 54 in the central region 58, this means that the first central line 70 and a normal line of the main plane 56 have a same direction, so that the light from the corresponding LED 66 in the central region 58 can be reflected by the corresponding first reflective lampshade 68 and be condensed to illuminate the middle region A of the illumination area 64. Please refer to FIG. 6. FIG. 6 is a radiation diagram illustrating the distribution of light from the LED devices in the central region according to the present invention. As shown in FIG. 6, the distribution of the light from each of the LEDs 66 in the central region 58 of this embodiment is between 30 degrees on the left-hand side and 30 degrees on the right-hand side. This means that the emitting angle range is substantially 60 degrees, but the emitting angle range is not limited to this. The emitting angle range can be adjusted according to the required brightness.

Figure 7:
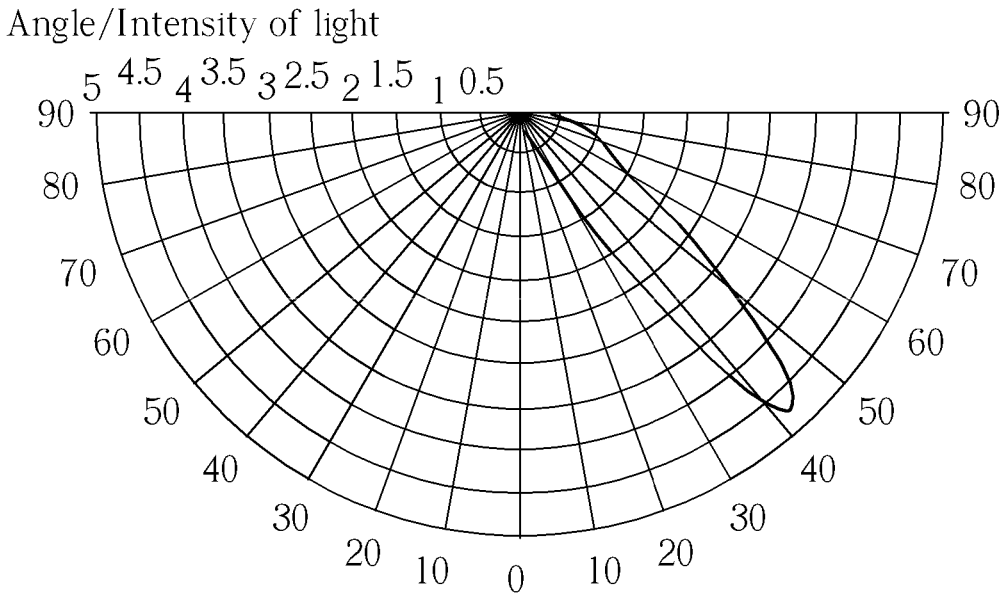
FIG. 7 is a radiation diagram illustrating the distribution of light from each of the LED devices in the peripheral region according to the present invention.

In addition, in each of the LED devices 54 in the peripheral region 60, the second central line 79 inclines outwards with respect to the central region 58, so that the light from the corresponding LED 66 in the peripheral region 60 can be reflected and directed by the second reflective lampshade 68. The light-exiting direction 62 of each of the LED devices 54 in the peripheral region 60 can go outwards with respect to the central region 58 so as to illuminate the surroundings or two opposite sides of the surrounding region B of the illumination area 64. Please refer to FIG. 7. FIG. 7 is a radiation diagram illustrating the distribution of light from each of the LED devices in the peripheral region according to the present invention. As shown in FIG. 7, the distribution of the light from each of the LED devices 54 in the peripheral region 60 at a right side of the central region 58 of this embodiment is between 30 degrees and 60 degrees on the right-hand side. This means that the emitting angle range is substantially 30 degrees, and the light-exiting direction deviates substantially 45 degrees outward with respect to the right side of the central region 58. Similarly, the emitting angle range of each of the LED devices 54 in the peripheral region 60 at a left side of the central region 58 of this embodiment is substantially 30 degrees. The light-exiting direction deviates substantially 45 degrees outward with respect to the left side of the central region 58. The present invention is not limited to the emitting angle range and the light-exiting direction, and the emitting angle range and the light-exiting direction can be adjusted according to the required brightness. Because the distribution of the light from each of the LED devices 54 in the peripheral region 60 deviates outwardly with respect to the central region 58, the surrounding region of the illumination area can be illuminated, and the illumination range of the illumination area illuminated by the illumination module can be raised.

Figure 8:
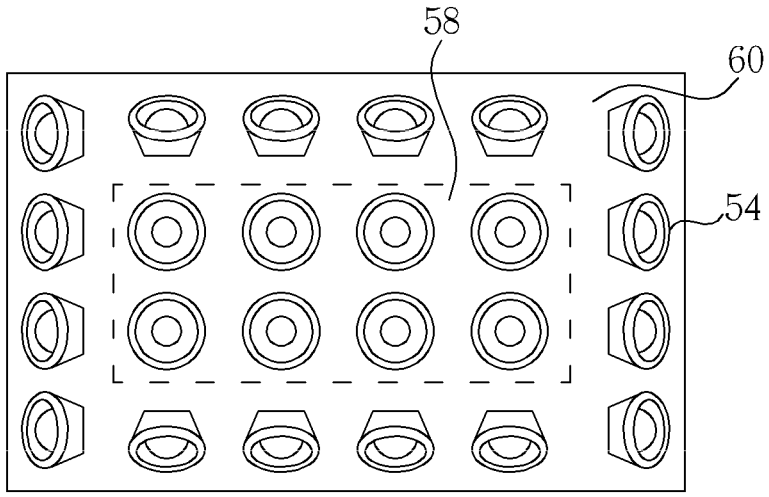
FIG. 8 and FIG. 9 are top-view schematic diagrams illustrating other examples of the illumination module of the present invention.
Figure 9:
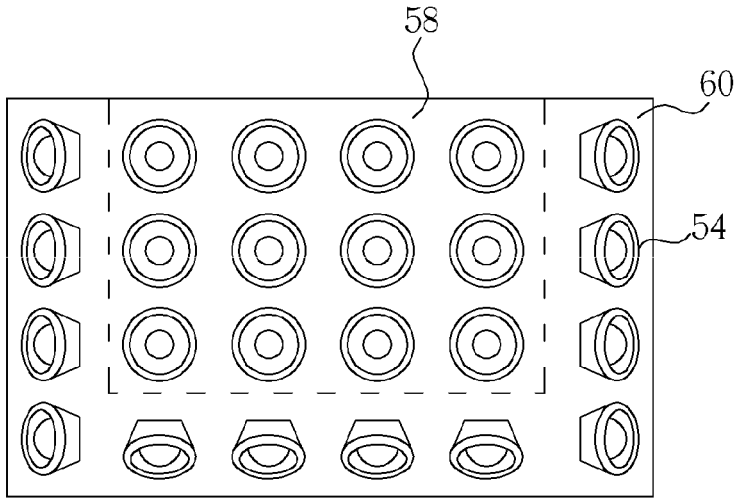

In addition, as shown in FIG. 5, the peripheral region 60 is preferably at two opposite sides of the central region 58 along a direction of a road 74 so as to extend the illumination range along the direction of the road 74 through the LED devices 54 in the peripheral region 60, but the present invention is not limited to this example. Please refer to FIG. 8 and FIG. 9. FIG. 8 and FIG. 9 are top-view schematic diagrams illustrating other examples of the illumination module of the present invention. As shown in FIG. 8, the peripheral region 60 can also surround the central region 58. As shown in FIG. 9, the peripheral region 60 can be at a side of the central region 58.

Figure 10:
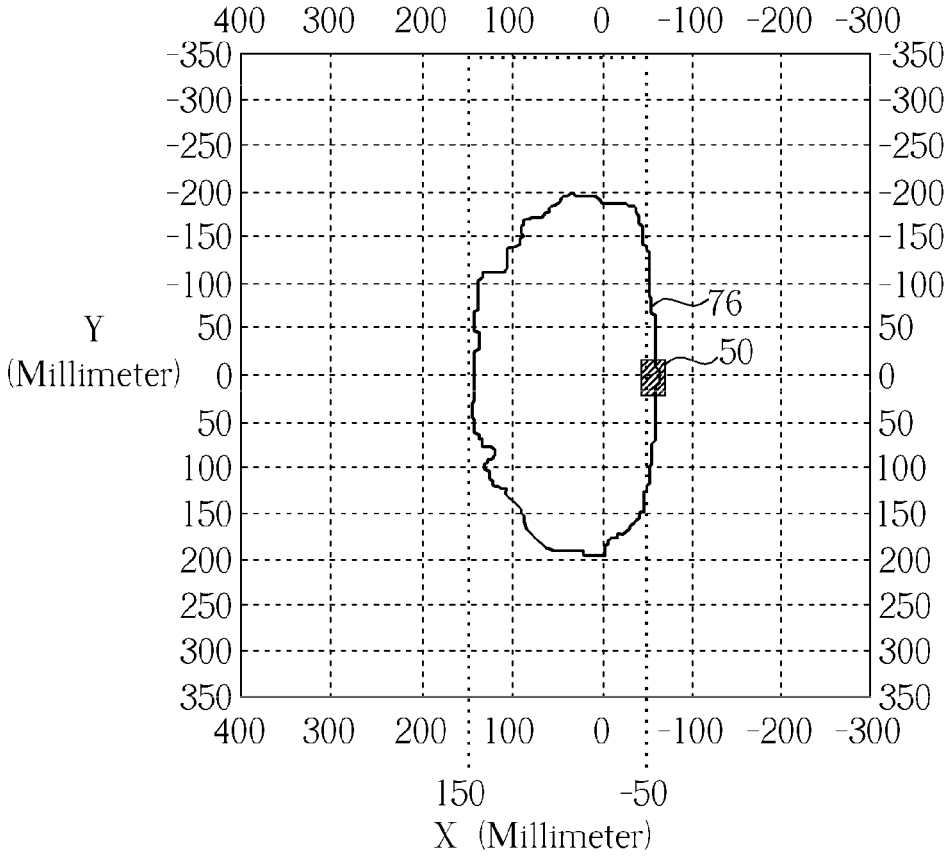
FIG. 10 is a schematic diagram illustrating the intensity distribution of light from the illumination module of the present invention.
Figure 11:
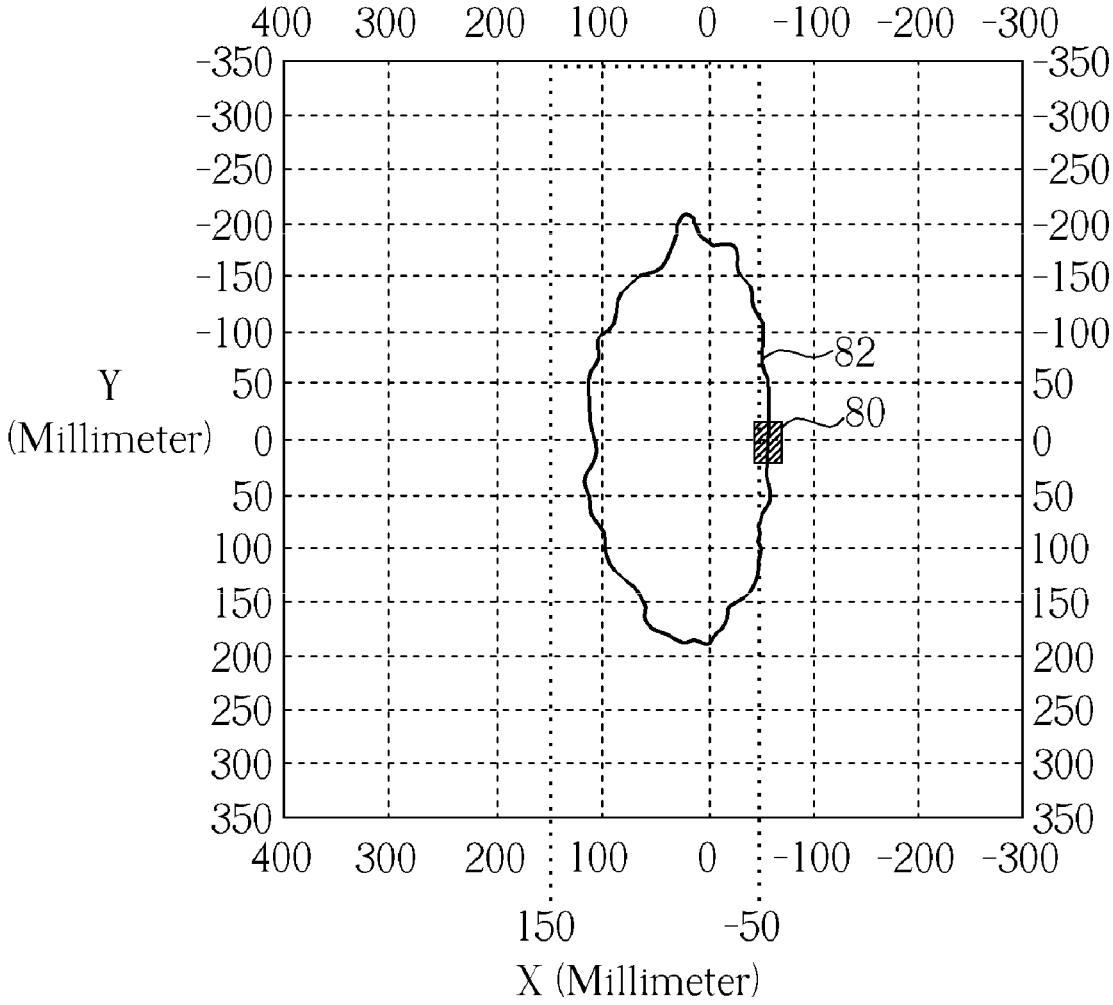
FIG. 11 is a schematic diagram illustrating the intensity distribution of the light from a streetlamp according to the actual illumination requirements.

Please refer to FIG. 10, which is a schematic diagram illustrating the intensity distribution of light from the illumination module of the present invention. As shown in FIG. 10, the illumination module 50 of the present invention is disposed over −50 millimeters of the x-axis and at the origin of the y-axis. When the measured intensity of the light of the distribution curve is 25 watts per square meter, the distribution curve of the light from the illumination module of the present invention is between 175 millimeters and −175 millimeters of the y-axis and between 150 millimeters and −60 millimeters of the x-axis. As compared with the distribution curve 18 of the prior art, which is between 150 millimeters and −50 millimeters of the x-axis and between 110 millimeters and −110 millimeters of the y-axis, the intensity distribution of the light at the y-axis of the illumination module of the present invention 50 is obviously larger than the intensity distribution of the light at the y-axis of the prior art. Furthermore, in order to illustrate the actual illumination requirements of a streetlamp, please refer to FIG. 11, which is a schematic diagram illustrating the intensity distribution of the light from a streetlamp according to the actual illumination requirements. As shown in FIG. 11, a streetlamp 80 is also disposed over −50 millimeters of the x-axis and at the origin of the y-axis. When the measured intensity of the light of the distribution curve is 25 watts per square meter, the distribution curve 82 of the light of the y-axis is between 190 millimeters and −200 millimeters, and the distribution curve 82 of the light of the x-axis is between 120 millimeters and −50 millimeters. Therefore, the illumination module of the present invention can achieve the desired illumination range and satisfy the actual requirements of the streetlamp.

As the above-mentioned description clearly details, the present invention disposes the reflective lampshades respectively surrounding each of the LEDs and changes the inclined direction and angle of each of the reflective lampshades in the peripheral region to adjust the illumination range of each of the LEDs. Therefore, the problem of the limitation of the illumination range of the prior art can be solved, and the required illumination range of the streetlamp can be achieved. It should be noted that the illumination application of the present invention is not limited to be applied to a streetlamp, and can be applied to any kind of illumination lamp according to design requirements.

Those skilled in the art will readily observe that numerous modifications and alterations of the device and method may be made while retaining the teachings of the invention.

What is claimed is:

1. An illumination module, comprising:

a substrate, having a main plane, the main plane comprising a central region and a peripheral region; and a plurality of light emitting diode (LED) devices, disposed on the main plane of the substrate in the central region and the peripheral region, each of the LED devices having a light-exiting direction, and each of the LED devices comprising:

an LED; and a reflective lampshade surrounding the LED and being attached on the substrate, and each of the reflective lampshades having a central line, wherein an included angle between the central line and a sidewall of each of the reflective lampshades in the central region is larger than an included angle between the central line and a sidewall of each of the reflective lampshades in the peripheral region so that an emitting angle range of each of the LEDs in the central region is larger than an emitting angle range of each of the LEDs in the peripheral region;

wherein the light-exiting direction of each of the LED devices disposed in the central region is substantially perpendicular to the main plane, and the light-exiting direction of each of the LED devices disposed in the peripheral region goes outwards with respect to the central region.

2. The illumination module of claim 1, wherein the LED devices are arranged as a dot matrix.

3. The illumination module of claim 1, wherein a sidewall of each of the reflective lampshades in the central region is symmetric about the central line of the corresponding reflective lampshade.

4. The illumination module of claim 1, wherein the central line of each of the reflective lampshades in the peripheral region inclines outwards with respect to the central region.

5. The illumination module of claim 1, wherein the peripheral region surrounds the central region.

6. The illumination module of claim 1, wherein the peripheral region is disposed at two opposite sides of the central region.

7. The illumination module of claim 1, wherein the peripheral region is disposed at a side of the central region.

8. An illumination module, comprising:

a substrate, having a main plane, the main plane comprising a central region and a peripheral region;

a plurality of LEDs, disposed on the main plane of the substrate in the central region and the peripheral region;

a plurality of first reflective lampshades, each first reflective lampshade respectively having a first central line, each of the first reflective lampshades being attached to the substrate in the central region and surrounding each of the LEDs in the central region, the first central line of each of the first reflective lampshades being perpendicular to the main plane; and a plurality of second reflective lampshades, each second reflective lampshade respectively having a second central line, each of the second reflective lampshades being attached to the substrate in the peripheral region and surrounding each of the LEDs in the peripheral region, and the second central line of each of the second reflective lampshades inclining outwards with respect to the central region, so that a light-exiting direction of each of the LEDs in the peripheral region goes outwards with respect to the central region through the corresponding second reflective lampshade, wherein a first included angle between the first central line and a sidewall of each of the first reflective lampshades is larger than a second included angle between a sidewall and the second central line of each of the second reflective lampshades, so that an emitting angle range of each of the LEDs in the central region through the corresponding first reflective lampshade is larger than an emitting angle range of each of the LEDs in the peripheral region through the corresponding second reflective lampshade.

9. The illumination module of claim 8, wherein the LEDs are arranged as a dot matrix.

10. The illumination module of claim 8, wherein the peripheral region surrounds the central region.

11. The illumination module of claim 8, wherein the peripheral region is disposed at two opposite sides of the central region.

12. The illumination module of claim 8, wherein the peripheral region is disposed at a side of the central region.

* * * * *